US011177583B2

(12) United States Patent
Yang et al.

(10) Patent No.: US 11,177,583 B2
(45) Date of Patent: Nov. 16, 2021

(54) ELECTRONIC DEVICE AND ANTENNA STRUCTURE THEREOF

(71) Applicant: PEGATRON CORPORATION, Taipei (TW)

(72) Inventors: Hui-An Yang, Taipei (TW); Jung-Yi Huang, Taipei (TW); Kuan-Chuan Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/699,467

(22) Filed: Nov. 29, 2019

(65) Prior Publication Data

US 2020/0235495 A1 Jul. 23, 2020

(30) Foreign Application Priority Data

Jan. 21, 2019 (TW) ..... 108201011

(51) Int. Cl.
*H01Q 1/42* (2006.01)
*H01Q 21/30* (2006.01)
*H01Q 21/24* (2006.01)

(52) U.S. Cl.
CPC ..... *H01Q 21/30* (2013.01); *H01Q 21/24* (2013.01)

(58) Field of Classification Search
CPC ..... H01Q 21/30; H01Q 21/24; H01Q 21/28; H01Q 9/26; H01Q 1/241; H01Q 5/20;
(Continued)

(56) References Cited

U.S. PATENT DOCUMENTS 8,207,898 B2 * 6/2012 Koyanagi ..... H01Q 9/42 343/702
8,362,960 B2 * 1/2013 Mumbru ..... H01Q 5/371 343/702

(Continued)

FOREIGN PATENT DOCUMENTS

CN 1270409 8/2006
KR 20140013827 2/2014

(Continued)

OTHER PUBLICATIONS

"Search Report of Europe Counterpart Application", dated Jun. 16, 2020, p.1-p.13.

(Continued)

*Primary Examiner* — Jean B Jeanglaude
(74) *Attorney, Agent, or Firm* — J.C. Patents

(57) ABSTRACT

An antenna structure includes a first antenna, a second antenna, a third antenna, and a first grounding portion. The first antenna and the second antenna operate at a first frequency. The first antenna is disposed side by side with the second antenna, and the first antenna and the second antenna are orthogonally polarized. The third antenna operates at a second frequency, and the second frequency is lower than the first frequency. The first grounding portion includes a first side edge and a second side edge opposite to each other. The first antenna and the second antenna are connected to the first side edge and the third antenna is connected to the second side edge. An electronic device includes the said antenna structure.

13 Claims, 11 Drawing Sheets

(58) Field of Classification Search
CPC ..... H01Q 1/52; H01Q 25/00; H01Q 5/307; H01Q 25/001; H01Q 9/285; H01Q 1/2291
USPC ..... 343/872
See application file for complete search history.

(56) References Cited

U.S. PATENT DOCUMENTS

| | | | | |
|---|---|---|---|---|
| 9,281,565 | B2 * | 3/2016 | Chiu | H01Q 1/2266 |
| 9,306,277 | B2 * | 4/2016 | Miyake | H01Q 1/48 |
| 10,270,185 | B2 * | 4/2019 | Boutayeb | H01Q 21/30 |
| 2002/0190905 | A1 | 12/2002 | Flint et al. | |
| 2004/0257283 | A1 | 12/2004 | Asano et al. | |
| 2009/0146885 | A1 * | 6/2009 | Su | H01Q 5/371 343/700 MS |
| 2011/0175782 | A1 | 7/2011 | Choi et al. | |
| 2011/0187616 | A1 * | 8/2011 | Iso | H01Q 21/28 343/725 |
| 2013/0027257 | A1 * | 1/2013 | Tanaka | H01Q 1/1271 343/713 |
| 2013/0307733 | A1 * | 11/2013 | Chiu | H01Q 9/26 343/700 MS |
| 2014/0191918 | A1 | 7/2014 | Cheng et al. | |
| 2015/0070222 | A1 | 3/2015 | Kang et al. | |
| 2015/0236417 | A1 * | 8/2015 | Iellci | H01Q 5/378 343/850 |
| 2017/0179591 | A1 * | 6/2017 | Kuang | H01Q 1/528 |
| 2018/0175515 | A1 * | 6/2018 | Boutayeb | H01Q 21/245 |

FOREIGN PATENT DOCUMENTS

| | | |
|---|---|---|
| TW | M359814 | 6/2009 |
| TW | I318809 | 12/2009 |

OTHER PUBLICATIONS

"Office Action of Korea Counterpart Application", dated Sep. 16, 2020, with English translation thereof, pp. 1-8.

* cited by examiner

| | Frequency (MHz) | X-Z plane | | Y-Z plane | | X-Y plane | | Sum of polarization vectors (dBi) | Efficiency (%) |
|---|---|---|---|---|---|---|---|---|---|
| | | Maximum gain (dBi) | Average gain (dBi) | Maximum gain (dBi) | Average gain (dBi) | Maximum gain (dBi) | Average gain (dBi) | | |
| Third antenna | 2400 | 3.93 | -2.24 | -0.20 | -3.03 | 3.40 | -1.96 | 4.23 | 66% |
| | 2450 | 4.26 | -2.14 | 0.02 | -3.00 | 3.70 | -2.40 | 4.90 | 62% |
| | 2500 | 3.58 | -2.18 | 0.56 | -2.54 | 3.86 | -2.28 | 3.89 | 65% |
| First antenna | 5150 | 2.54 | -3.74 | 3.13 | -0.71 | 3.16 | -2.51 | 4.64 | 71% |
| | 5350 | 1.73 | -4.19 | 3.08 | -1.60 | 2.90 | -2.56 | 6.48 | 69% |
| | 5470 | 1.81 | -3.85 | 3.66 | -1.43 | 4.29 | -19.1 | 5.96 | 73% |
| | 5725 | 3.07 | -3.88 | 5.26 | -0.99 | 5.48 | -2.66 | 5.68 | 75% |
| | 5850 | 3.81 | -4.13 | 5.72 | -0.95 | 4.16 | -3.29 | 6.85 | 75% |
| Second antenna | 5150 | 3.75 | -2.82 | 1.48 | -5.01 | 4.85 | -1.96 | 5.63 | 64% |
| | 5350 | 4.15 | -2.01 | 3.28 | -4.60 | 3.97 | -1.43 | 6.32 | 66% |
| | 5470 | 4.87 | -2.13 | 3.12 | -4.51 | 5.11 | -1.54 | 5.21 | 61% |
| | 5725 | 3.77 | -2.23 | 4.38 | -3.41 | 4.12 | -2.38 | 4.81 | 64% |
| | 5850 | 3.29 | -2.69 | 3.94 | -3.53 | 4.38 | -2.07 | 5.19 | 63% |

FIG. 8

ELECTRONIC DEVICE AND ANTENNA STRUCTURE THEREOF

CROSS-REFERENCE TO RELATED APPLICATION

This application claims the priority benefit of Taiwan application serial no. 108201011, filed on Jan. 21, 2019. The entirety of the above-mentioned patent application is hereby incorporated by reference herein and made a part of this specification.

BACKGROUND

Technical Field

The present disclosure relates to an antenna structure and an electronic device, and in particular, to a multi-band antenna structure and an electronic device having the multi-band antenna structure.

Related Art

With the development of wireless communications technologies, an antenna configured to transmit and receive electric waves is an important component. Generally, to enable a terminal device support multiple frequencies, a commonly used method is to configure a plurality of single-band antennas in the terminal device. However, low isolation between the single-band antennas leads to mutual interference between the single-band antennas, affecting the quality of wireless communication. An attempt to increase the isolation by increasing the distance between the sing-frequency antennas will inevitably increase the volume of the terminal device, making it difficult to meet the design requirements of product miniaturization.

Another method is to configure a dipole antenna in the terminal device, to meet the design requirements of product miniaturization. A common dipole antenna includes a frequency divider configured to divide two signals of different frequencies into two antenna modules. However, the configuration of the frequency divider increases manufacturing costs and affects the wireless transmission quality because of filtering requirements.

SUMMARY

The present disclosure provides an antenna structure and an electronic device, which can operate at a plurality of frequencies and have good wireless transmission quality.

The antenna structure of the present disclosure includes a first antenna, a second antenna, a third antenna, and a first grounding portion. The first antenna and the second antenna operate at a first frequency. The first antenna is disposed side by side with the second antenna, and the first antenna and the second antenna are orthogonally polarized. The third antenna operates at a second frequency, and the second frequency is lower than the first frequency. The first grounding portion includes a first side edge and a second side edge opposite to each other. The first antenna and the second antenna are connected to the first side edge and the third antenna is connected to the second side edge.

The electronic device of the present disclosure includes a body and at least one antenna structure. The antenna structure is as described above. The antenna structure is disposed around the body and is electrically connected to the body.

Based on the above, the antenna structure of the present disclosure integrates a plurality of antennas, and the antennas operate at two or more different frequencies. In addition, polarization directions of antennas with the same frequency are orthogonal to each other, so that the isolation between the antennas can be increased. Therefore, the antenna structure and the electronic device using the antenna structure of the present disclosure not only can operate at multiple frequencies, but also have good wireless transmission quality. Moreover, the electronic device using the antenna structure can reduce the number of antennas required, thereby reducing the manufacturing costs and meeting the design requirements of product miniaturization.

In order to make the aforementioned features and advantages of the present disclosure more comprehensible, embodiments are further described in detail hereinafter with reference to accompanying drawings.

BRIEF DESCRIPTION OF THE DRAWINGS

FIG. 8 is a diagram illustrating a gain-efficiency relationship of the first antenna to the third antenna of FIG. 1.

DETAILED DESCRIPTION

Figure 1:
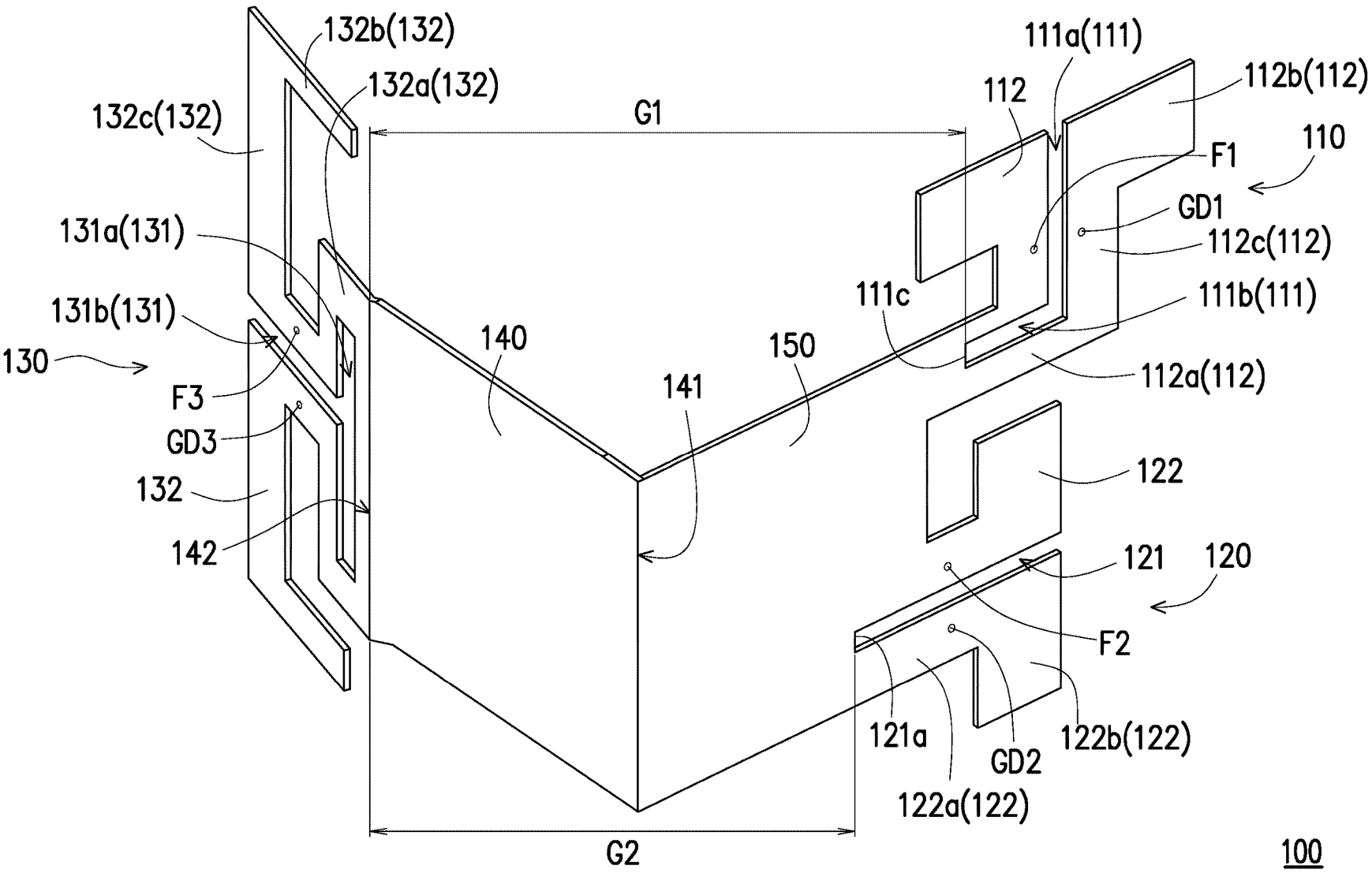
FIG. 1 is a schematic diagram of an antenna structure according to an embodiment of the present disclosure.
Figure 2:
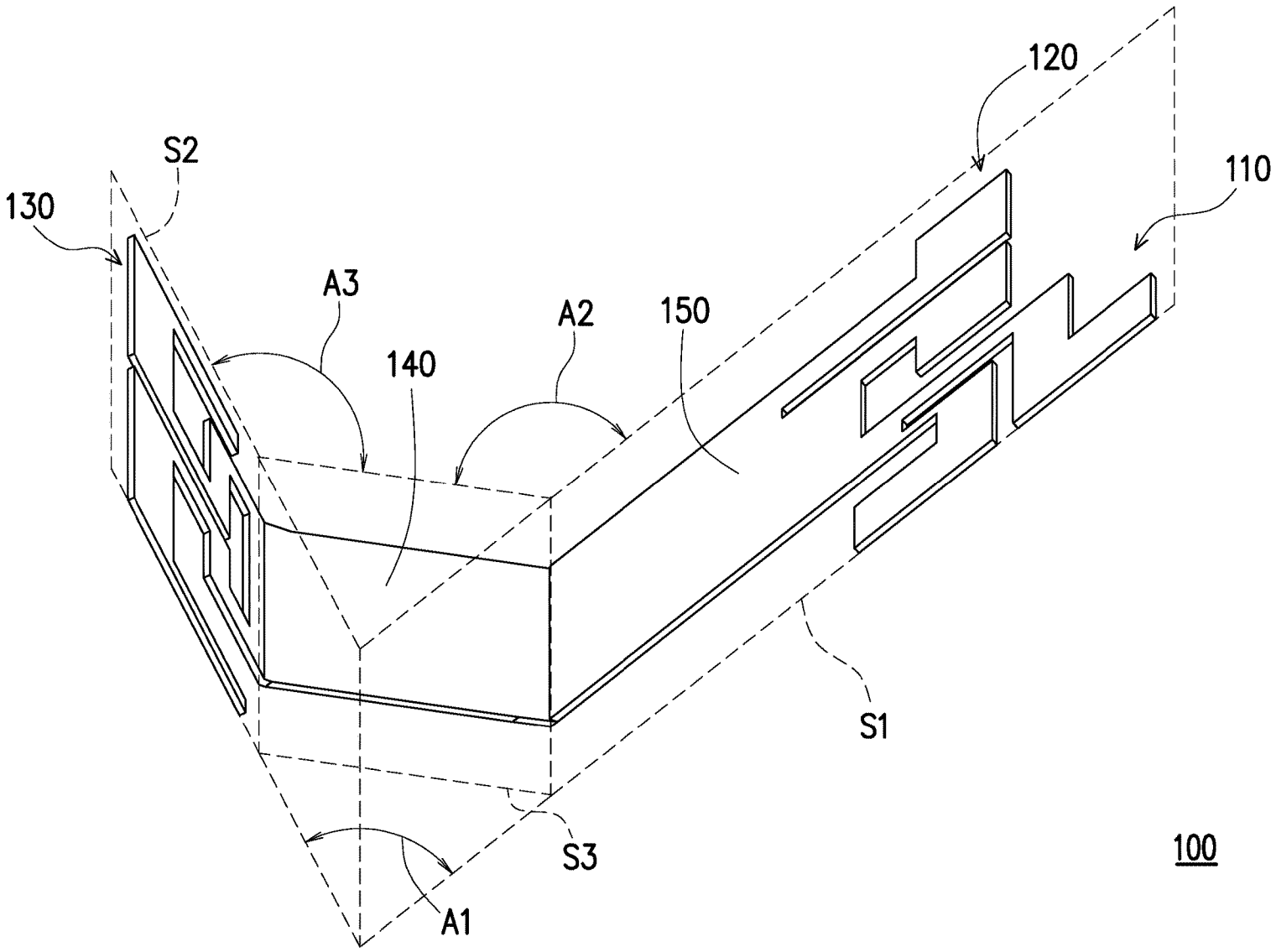
FIG. 2 is a schematic diagram of the antenna structure of FIG. 1 from another viewing angle.

FIG. 1 is a schematic diagram of an antenna structure according to an embodiment of the present disclosure. FIG. 2 is a schematic diagram of the antenna structure of FIG. 1 from another viewing angle. Referring to FIG. 1 and FIG. 2, in this embodiment, the antenna structure 100 is a multi-band antenna structure, and can operate at two or more operating frequencies. One operating frequency may range from 2400 MHz to 2500 MHz and another operating frequency may range from 5150 MHz to 5850 MHz. The present disclosure is not limited thereto.

Further, the antenna structure 100 includes a first antenna 110, a second antenna 120, a third antenna 130, and a first grounding portion 140. The antenna structure 100 may be made by stamping and is an integrally formed metal sheet structure. The first grounding portion 140 includes a first side edge 141 and a second side edge 142 opposite to each other. The first antenna 110 and the second antenna 120 are connected to the first side edge 141 and the third antenna 130 is connected to the second side edge 142. The first antenna 110 and the second antenna 120 operate at a first frequency, for example, ranging from 5150 MHz to 5850 MHz. The third antenna 130 operates at a second frequency, for example, ranging from 2400 MHz to 2500 MHz. The third antenna 130 may also operate at another frequency, for example, ranging from 5150 MHz to 5850 MHz, or may operate at another operating frequency satisfying the first generation (1G) to fifth generation (5G) mobile communications technology standards, depending on design requirements.

In this embodiment, the first antenna 110, the second antenna 120, and the third antenna 130 are respectively located at two opposite sides of the first grounding portion 140, to prevent the first antenna 110 and the second antenna 120 from being too close to and interfering with the third antenna 130, thereby providing good isolation. The first antenna 110 and the second antenna 120 are disposed side by side on the same side (that is, the first side edge 141 of the first grounding portion 140) and are orthogonally polarized, so that the distance between the first antenna 110 and the second antenna 120 can be reduced while maintaining high isolation, thereby reducing the configuration space required by the antenna structure 100.

As shown in FIG. 2, the antenna structure 100 may basically be divided into three configuration planes. The first antenna 110 and the second antenna 120 are disposed on a first plane S1, the third antenna 130 is disposed on a second plane S2, and the first grounding portion 140 is disposed on a third plane S3. The configuration of the first antenna 110 and the second antenna 120 on the same plane S1 helps reduce the configuration space required by the antenna structure 100. An angle A1 between the first plane S1 and the second plane S2 ranges from 75 degrees to 90 degrees, to ensure that a sufficient distance is maintained between the first antenna 110 and second antenna 120 and the third antenna 130. In addition, an angle A2 between the first plane S1 and the third plane S3 is an obtuse angle, and an angle A3 between the second plane S2 and the third plane S3 is an obtuse angle, to ensure that a sufficient distance is maintained between the first antenna 110 and second antenna 120 and the third antenna 130.

As shown in FIG. 1, the antenna structure 100 further includes a second grounding portion 150. The first antenna 110 and the second antenna 120 are connected to the first side edge 141 of the first grounding portion 140 through the second grounding portion 150, and the first antenna 110, the second antenna 120, and the second grounding portion 150 are disposed on the same plane (that is, the first plane S1), thereby reducing the configuration space required by the antenna structure 100. To be specific, there is a bend between the first grounding portion 140 and the second grounding portion 150, and an obtuse angle exists between the first grounding portion 140 and the second grounding portion 150, as shown in FIG. 2.

Figure 3:
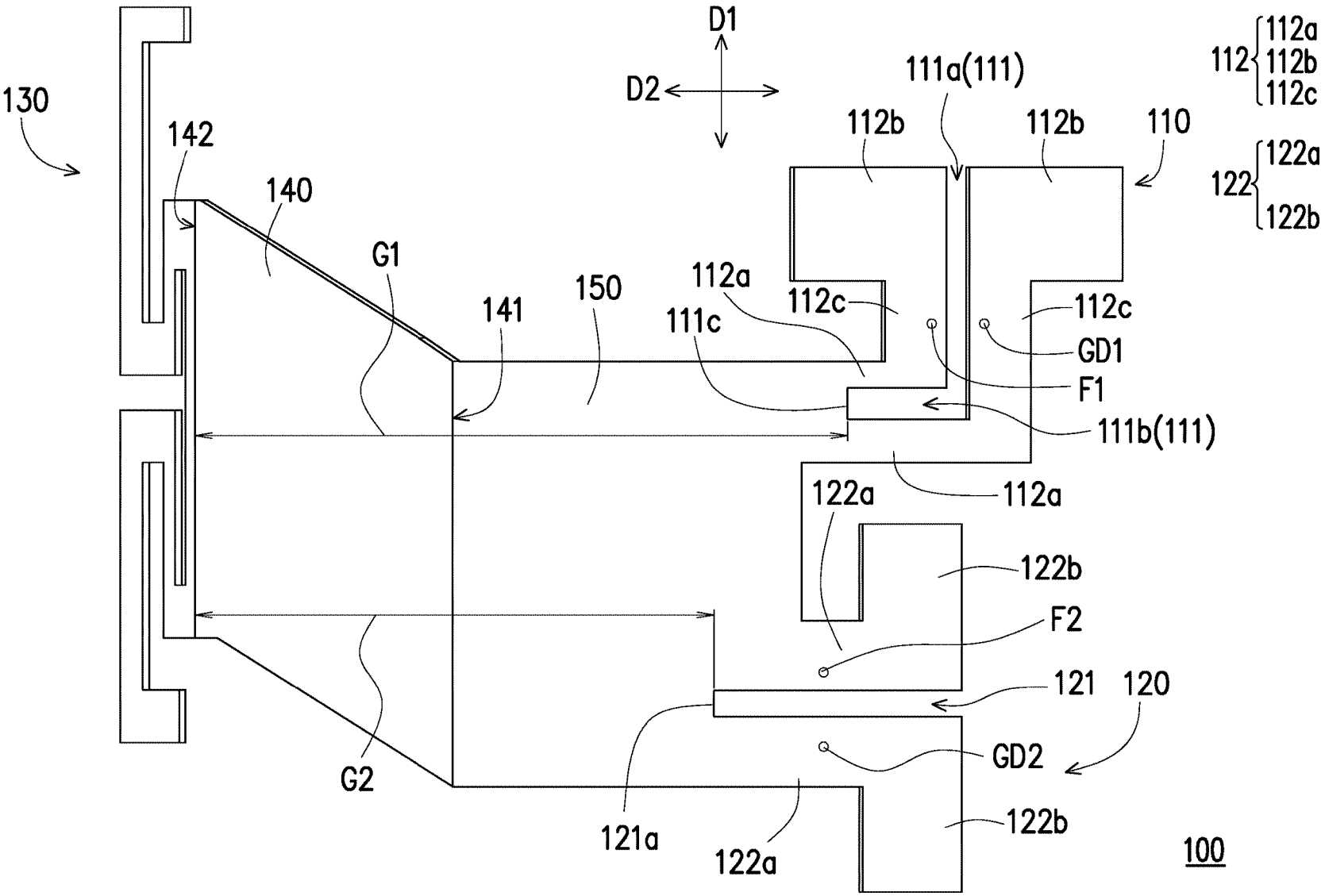
FIG. 3 is a schematic side view taken from the front side of a first antenna and a second antenna of FIG. 1.
Figure 4:
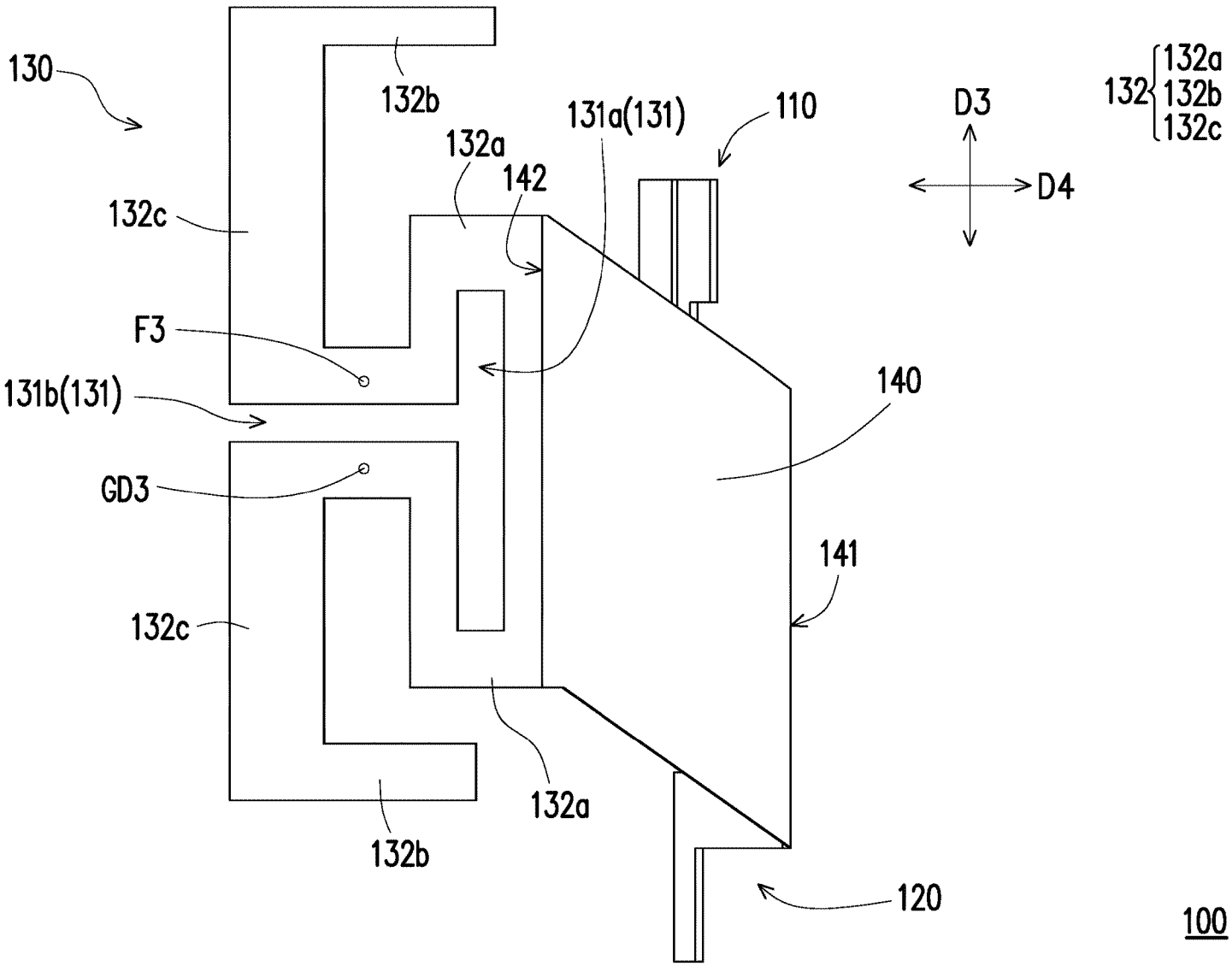
FIG. 4 is a schematic side view taken from the front side of a third antenna of FIG. 1.

FIG. 3 is a schematic side view taken from the front side of the first antenna and the second antenna of FIG. 1. FIG. 4 is a schematic side view taken from the front side of the third antenna of FIG. 1. Referring to FIG. 1 to FIG. 4, in this embodiment, the first antenna 110 includes a first slot 111 dividing the first antenna 110 into two first branches 112. The first slot 111 includes a first segment 111*a* extending along a direction D1 and a second segment 111*b* extending along a direction D2 perpendicular to the direction D1. The second segment 111*b* extends toward the first side edge 141 of the first grounding portion 140, and an end 111*c* of the second segment 111*b* does not reach the first side edge 141 of the first grounding portion 140. The second antenna 120 includes a second slot 121 dividing the second antenna 120 into two second branches 122. The second slot 121 extends toward the first side edge 141 of the first grounding portion 140 along the direction D2, and an end 121*a* of the second slot 121 does not reach the first side edge 141 of the first grounding portion 140.

The shortest distance between the first antenna 110 and the third antenna 130 is the shortest distance G1 between the end 111*c* of the second segment 111*b* of the first slot 111 and the second side edge 142 of the first grounding portion 140. The shortest distance between the second antenna 120 and the third antenna 130 is the shortest distance G2 between the end 121*a* of the second slot 121 and the second side edge 142 of the first grounding portion 140. The shortest distance G1 is greater than the shortest distance G2, and the shortest distance G2 ranges, for example, from 30 mm to 35 mm, to prevent the first antenna 110 and the second antenna 120 from being too close to and interfering with the third antenna 130, thereby providing good isolation.

As shown in FIG. 3, each of the first branches 112 of the first antenna 110 includes a connection portion 112*a*, a radiation portion 112*b*, and an extension portion 112*c*. The two connection portions 112*a* are separated by the second segment 111*b* of the first slot 111 and are connected to the second grounding portion 150. The two extension portions 112*c* are separated by the first segment 111*a* of the first slot 111. In each of the first branches 112, the extension portion 112*c* is connected to the radiation portion 112*b* and the connection portion 112*a*. On the other hand, the two radiation portions 112*b* are separated by the first segment 111*a* and respectively extend opposite to each other in the direction D2. In the direction D2, the width of each radiation portion 112*b* is greater than the width of the corresponding extension portion 112*c*. In this embodiment, the first antenna 110 includes a feed-in point F1 and a ground point GD1. The feed-in point F1 is located at the extension portion 112*c* of one of the first branches 112, the ground point GD1 is located at the extension portion 112*c* of another first branch 112, and the length of each of the first branches 112 may be ¼+⅛ wavelength with respect to the first frequency. In another embodiment, the length of each first branch of the first antenna may be, but not limited to, ½ wavelength, ¼ wavelength, or ⅛ wavelength with respect to the first frequency, depending on design requirements.

As shown in FIG. 3, each second branch 122 of the second antenna 120 includes a connection portion 122*a* and a radiation portion 122*b*. The two connection portions 122*a* are separated by the second slot 121. The two radiation portions 122*b* are separated by the second slot 121 and extend opposite to each other in the direction D1. In each second branch 122, the radiation portion 122*b* is connected to the second grounding portion 150 through the connection portion 122*a*. In the direction D1, the width of the radiation portion 122*b* is greater than the width of the connection portion 122*a*. In this embodiment, the second antenna 120 includes a feed-in point F2 and a ground point GD2. The feed-in point F2 is located at the connection portion 122*a* of one of the second branches 122, the ground point GD2 is located at the connection portion 122*a* of another second branch 122, and the length of each of the second branches 122 may be (¼±⅛) wavelength with respect to the first frequency. In another embodiment, the length of each second branch of the second antenna may be, but not limited to, ½ wavelength, ¼ wavelength, or ⅛ wavelength with respect to the first frequency, depending on design requirements.

As shown in FIG. 4, the third antenna 130 includes a third slot 131 dividing the third antenna 130 into two third branches 132. The third slot 131 includes a first segment 131*a* and a second segment 131*b*. The first segment 131*a* is located between the second segment 131*b* and the second side edge 142 of the first grounding portion 140. Further, the first segment 131*a* extends along a direction D3, and the second segment 131*b* extends along a direction D4 perpendicular to the direction D3. Each third branch 132 of the third antenna 130 includes a connection portion 132*a*, a radiation portion 132*b*, and a bending portion 132*c*. The two connection portions 132*a* are separated by the first segment 131*a* and are connected to the second side edge 142 of the first grounding portion 140. The two bending portions 132*c* are separated by the second segment 131*b*. In each third branch 132, the bending portion 132*c* is configured to connect the radiation portion 132*b* and the connection portion 132*a*.

In this embodiment, the two third branches 132 are disposed at two opposite sides of the second segment 131*b*. The bending portion 132*c* of any of the third branches 132 first extends from the connection portion 132*a* toward the another third branch 132 along the direction D3, then extends away from the second side edge 142 of the first grounding portion 140 along the direction D4, and then extends away from the another third branch 132 along the direction D3, and finally the radiation portion 132*b* continues to extend toward the second side edge 142 of the first grounding portion 140 along the direction D4.

As shown in FIG. 4, in the direction D3, the two radiation portions 132*b* are located at two opposite sides of the two bending portions 132*c*, and the two connection portions 132*a* are disposed side by side between the two radiation portions 132*b*. In the direction D4, the width of each radiation portion 132*b* is greater than the width of an end segment of the corresponding bending portion 132*c* (that is, a segment, extending along the direction D3 and configured to connect to the radiation portion 132*b*, of the bending portion 132*c*). Based on the above configuration, the two third branches 132 of the third antenna 130 may be configured to transmit or receive electric waves from two different directions. The third antenna 130 includes a feed-in point F3 and a ground point GD3. The feed-in point F3 is located at the bending portion 132*c* of one of the third branches 132. The ground point GD3 is located at the bending portion 132*c* of another third branch 132. The feed-in point F3 and the ground point GD3 are, for example, respectively located at segments, extending along the direction D4, of the corresponding bending portions 132*c*. The length of each third branch 132 may be ¼+⅛ wavelength with respect to the second operating frequency. In another embodiment, the length of each third branch of the third antenna may be, but not limited to, ½ wavelength, ¼ wavelength, or ⅛ wavelength with respect to the second operating frequency, depending on design requirements.

Figure 5:
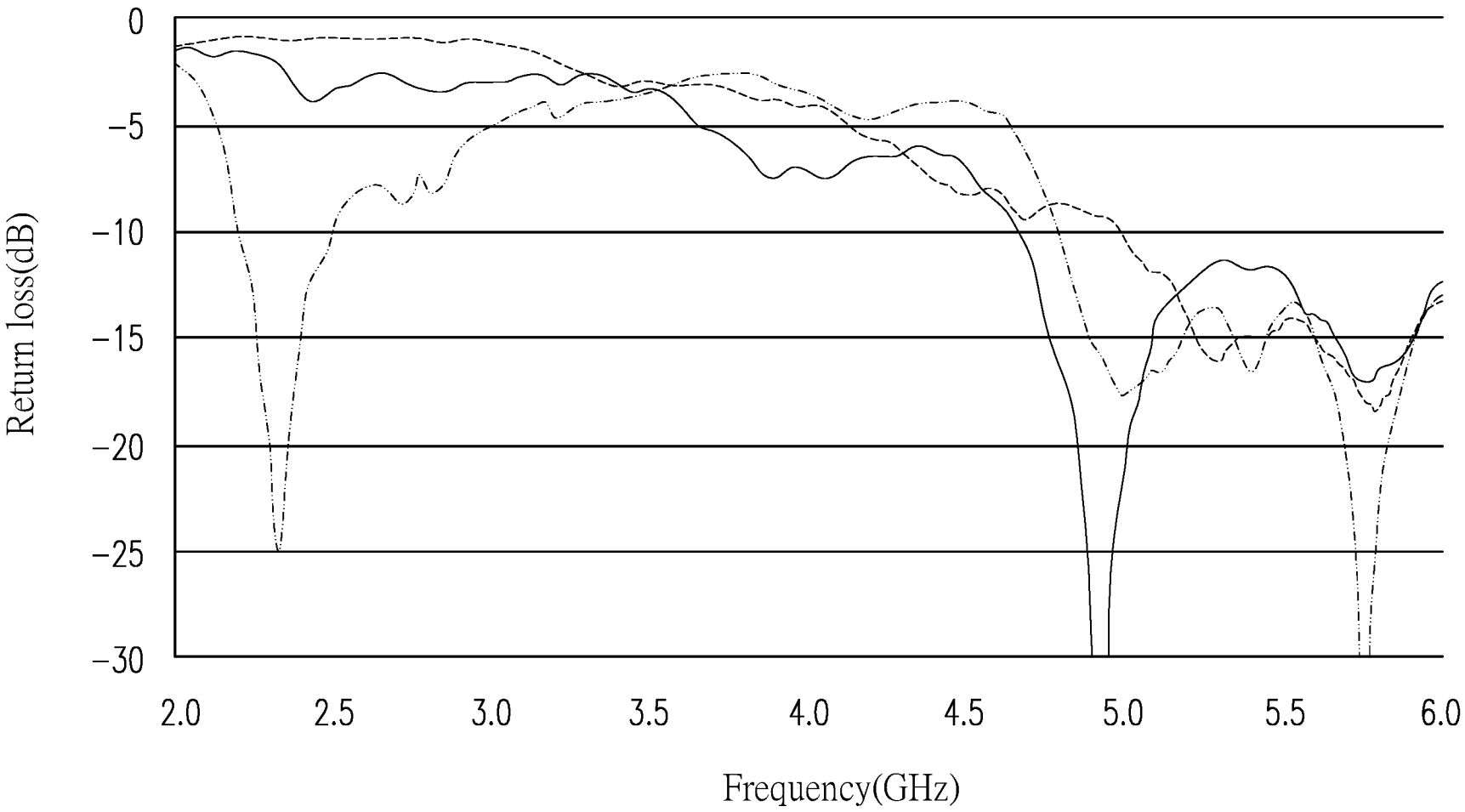
FIG. 5 is a schematic diagram illustrating a frequency-return loss relationship of the antenna structure of FIG. 1.

FIG. 5 is a schematic diagram illustrating a frequency-return loss relationship of the antenna structure of FIG. 1. Referring to FIG. 5, a resonance mode obtained by the first antenna 110 is represented by a solid line, a resonance mode obtained by the second antenna 120 is represented by a dashed line, and a resonance mode obtained by the third antenna 130 is represented by a dotted-dashed line. It can be seen from FIG. 5 that in the range of 2.4 GHz to 2.5 GHz, return losses of the resonance mode obtained by the third antenna 130 are all less than or equal to −10 dB, providing good performance. In the range of 5.15 GHz to 5.85 GHz, return losses of the resonance mode obtained by the first antenna 110 are all less than or equal to −10 dB, providing good performance. In the range of 5.15 GHz to 5.85 GHz, return losses of the resonance mode obtained by the second antenna 120 are all less than or equal to −10 dB, providing good performance.

Figure 6:
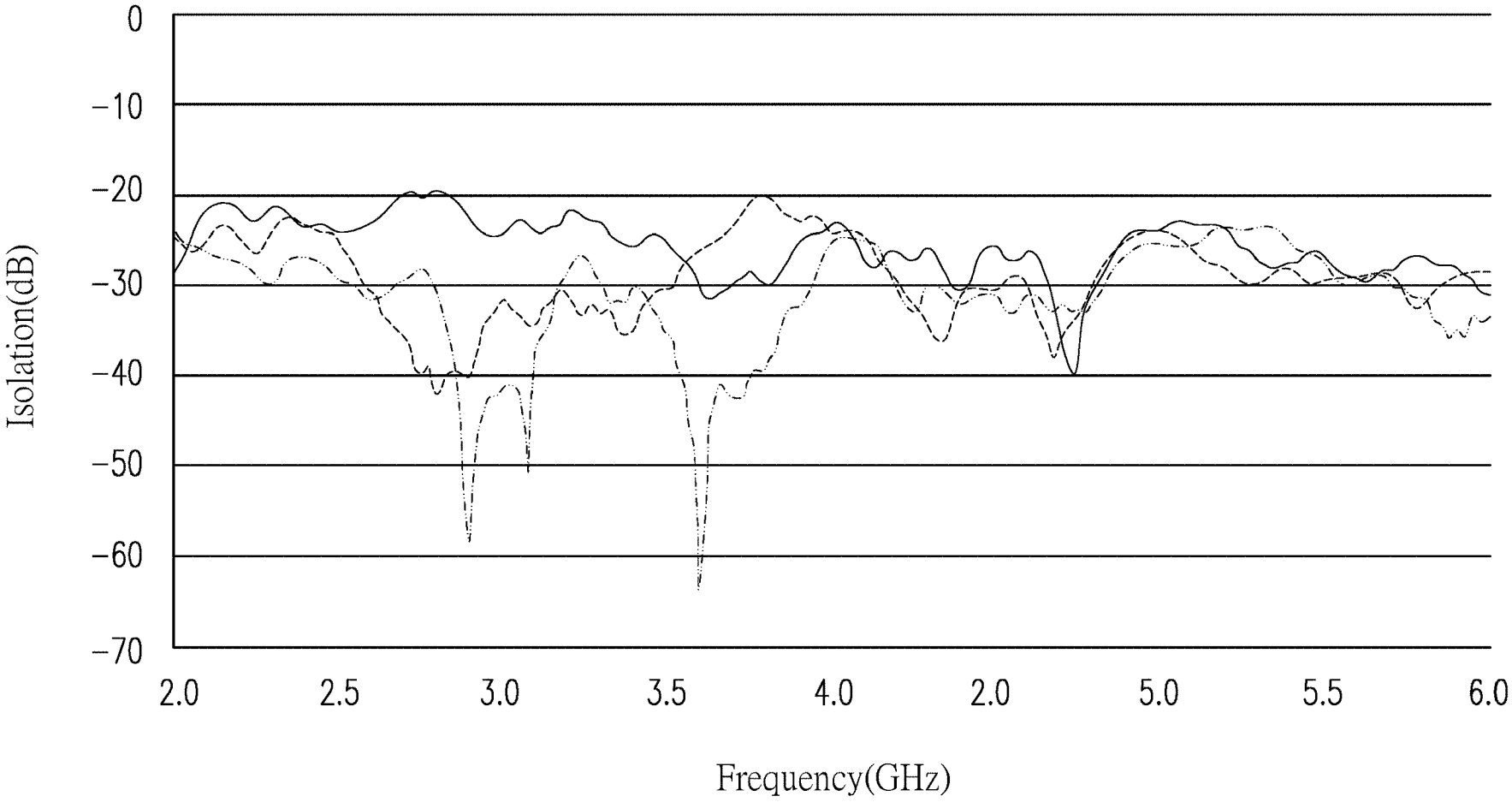
FIG. 6 is a schematic diagram illustrating a frequency-isolation relationship of the antenna structure of FIG. 1.

FIG. 6 is a schematic diagram illustrating a frequency-isolation relationship of the antenna structure of FIG. 1. Referring to FIG. 6, isolation between the third antenna 130 and the first antenna 110 is represented by a solid line, isolation between the third antenna 130 and the second antenna 120 is represented by a dashed line, and isolation between the first antenna 110 and the second antenna 120 is represented by a dotted-dashed line. It can be seen from FIG. 6 that the foregoing isolations are all lower than −20 dB. Therefore, the first antenna 110, the second antenna 120, and the third antenna 130 do not interfere with each other.

Figure 7A:
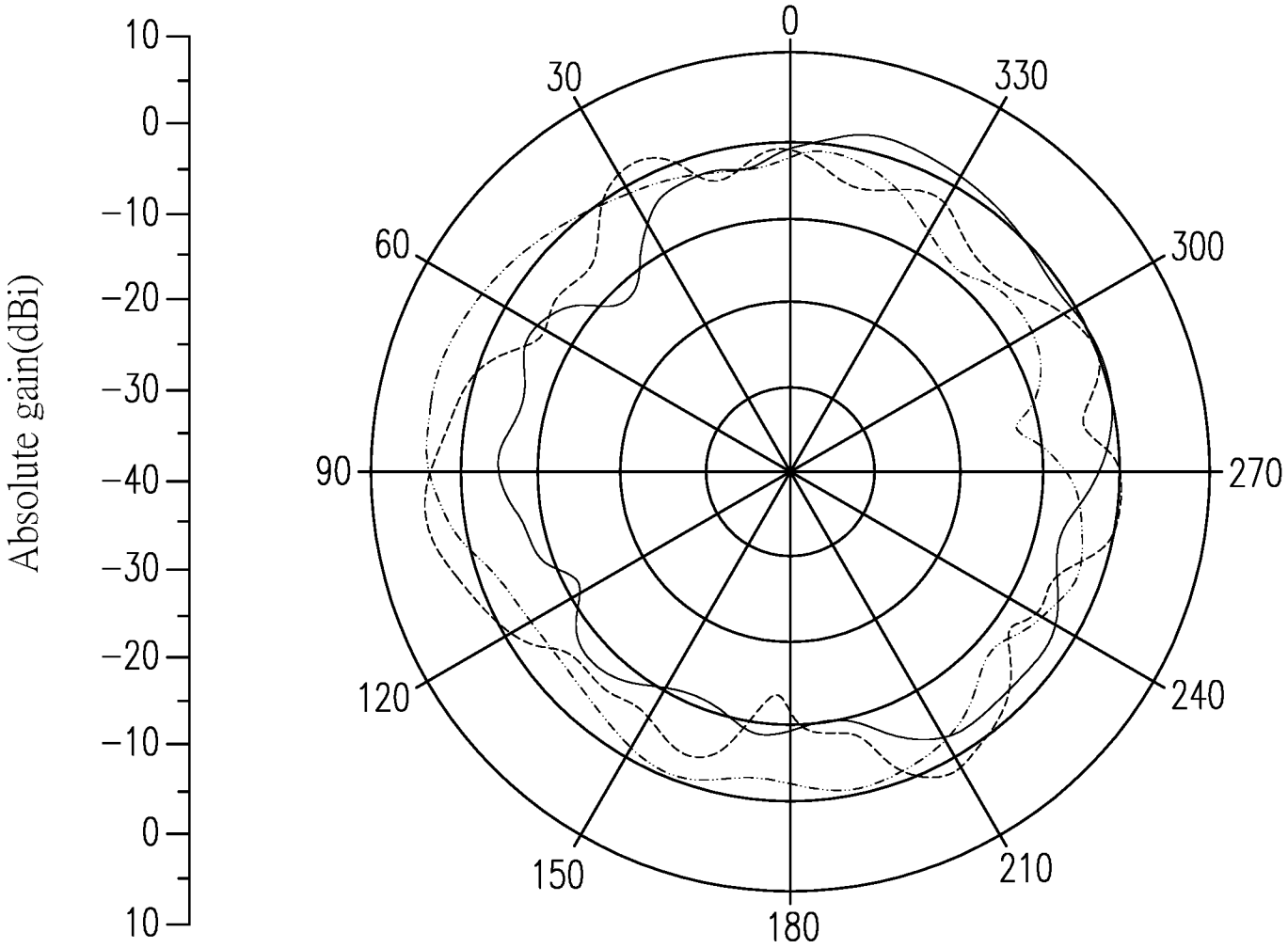
FIG. 7A to FIG. 7C are schematic diagrams of radiation patterns of the antenna structure of FIG. 1 in an X-Y plane, an X-Z plane, and a Y-Z plane.
Figure 7B:
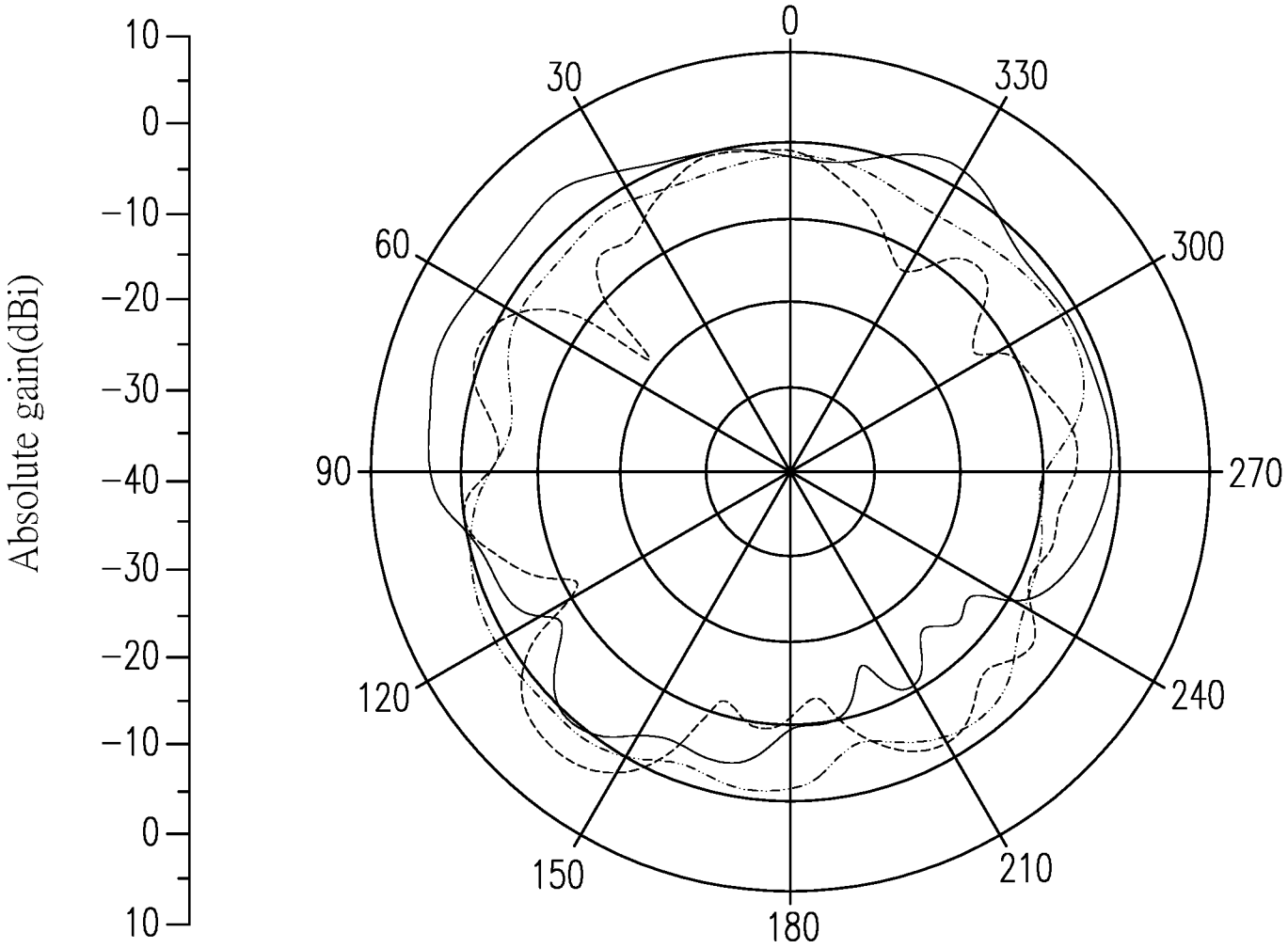
Figure 7C:
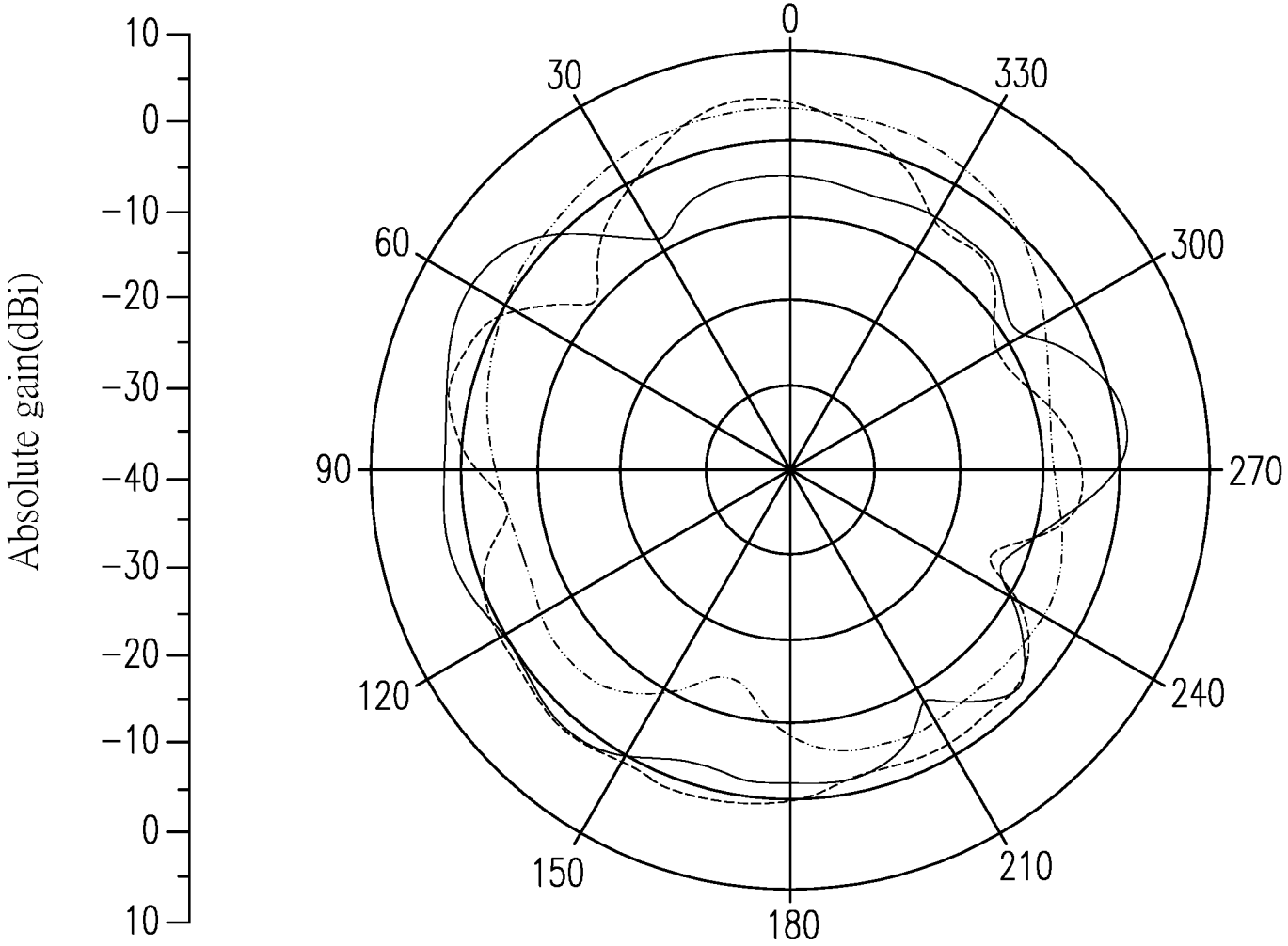

FIG. 7A to FIG. 7C are schematic diagrams of radiation patterns of the antenna structure of FIG. 1 in an X-Y plane, an X-Z plane, and a Y-Z plane. Referring to FIG. 7A to FIG. 7C, a radiation pattern of the first antenna 110 in the X-Y plane, the X-Z plane, and the Y-Z plane is represented by a solid line, a radiation pattern of the second antenna 120 in the X-Y plane, the X-Z plane, and the Y-Z plane is represented by a dashed line, and a radiation pattern of the third antenna 130 in the X-Y plane, the X-Z plane, and the Y-Z plane is represented by a dotted-dashed line. It can be seen from FIG. 7A to FIG. 7C that none of the radiation pattern of the first frequency of the first antenna 110, the radiation pattern of the first frequency of the second antenna 120, and the radiation pattern of the second frequency of the third antenna 130 includes a null point in the X-Y plane, the X-Z plane, and the Y-Z plane. Therefore, the first antenna 110, the second antenna 120, and the third antenna 130 have good omnidirectional performance.

FIG. 8 is a diagram illustrating a gain-efficiency relationship of the first antenna, the second antenna and the third antenna shown in FIG. 1. Referring to FIG. 8, assuming that the first antenna 110 and the second antenna 120 operate at five frequencies (5150 MHz, 5350 MHz, 5470 MHz, 5725 MHz, and 5850 MHz) and the third antenna 130 operates at three frequencies (2400 MHz, 2450 MHz, and 2500 MHz), measurement is performed on the X-Y plane, X-Z plane, and Y-Z plane, and a maximum gain, an average gain, a sum of polarization vectors, and efficiency of each antenna at a particular frequency and in a particular plane are respectively recorded. It can be seen from FIG. 8 that the efficiency of the first antenna 110 at each of the five frequencies (5150 MHz, 5350 MHz, 5470 MHz, 5725 MHz, and 5850 MHz) is greater than or equal to 69%, the efficiency of the second antenna 120 at each of the five frequencies (5150 MHz, 5350 MHz, 5470 MHz, 5725 MHz, and 5850 MHz) is greater than or equal to 61%, and the efficiency of the third antenna 130 at each of the three frequencies (2400 MHz, 2450 MHz, and 2500 MHz) is greater than or equal to 62%. Therefore, the antenna structure 100 has good wireless transmission efficiency and quality.

Figure 9:
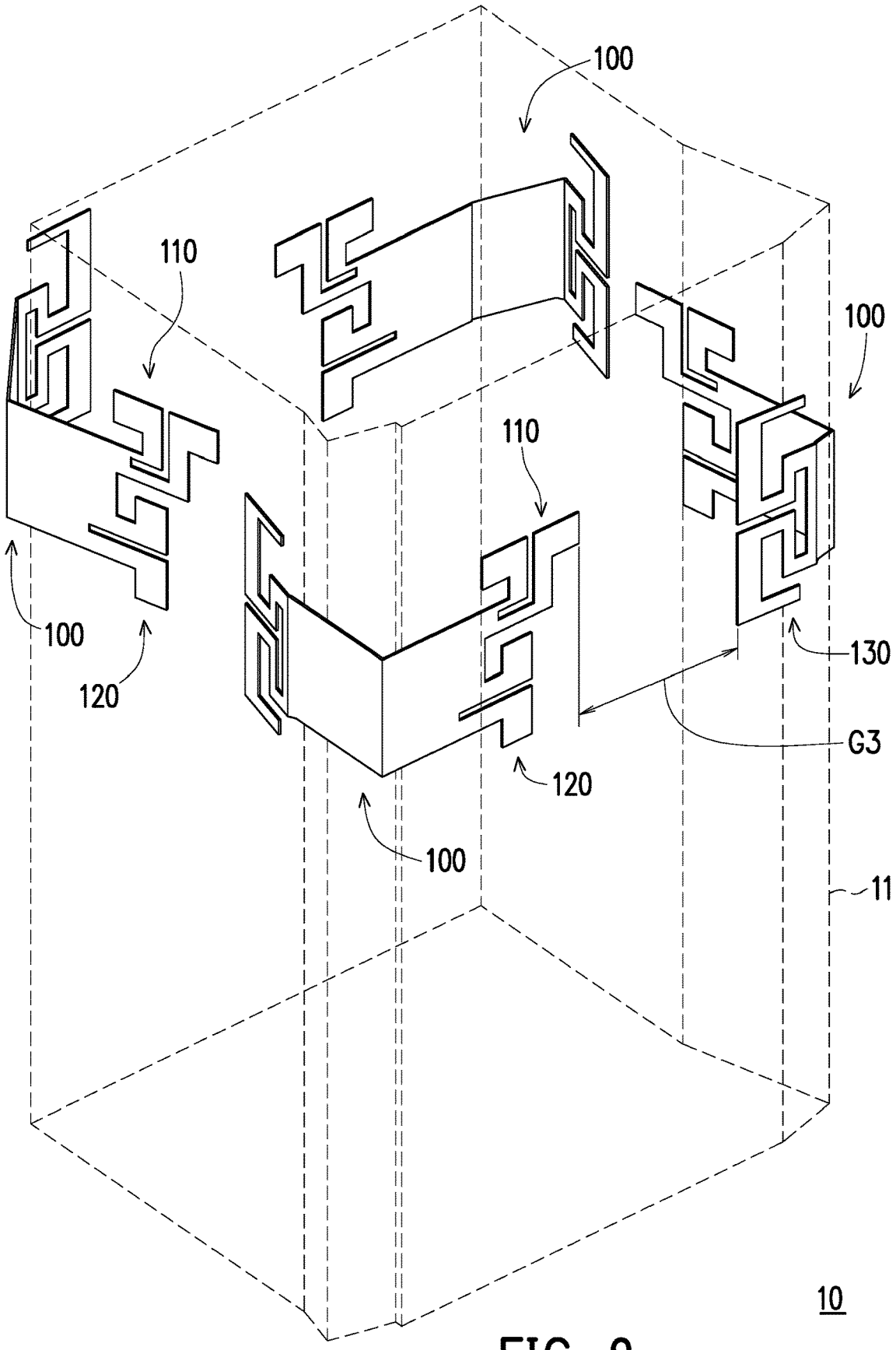
FIG. 9 is a schematic diagram of an electronic device according to an embodiment of the present disclosure.

FIG. 9 is a schematic diagram of an electronic device according to an embodiment of the present disclosure. Referring to FIG. 9, in this embodiment, the electronic device 10 uses the antenna structure 100 of the foregoing embodiments, and the number of antenna structures 100 is at least one. Four antenna structures 100 are shown in FIG. 9 schematically, but the present disclosure is not limited thereto. Further, the electronic device 10 includes a body 11, and the antenna structures 100 are evenly distributed around the body 11 and are electrically connected to the body 11, to transmit or receive electric waves at particular frequencies to or from different directions. Because the antenna structure 100 can operate at multiple frequencies, the number of antennas required by the electronic device 10 can be reduced, thereby reducing manufacturing costs and meeting the design requirements of product miniaturization.

For example, the first antenna 110 and the second antenna 120 of one of the antenna structures 100 and the third antenna 130 of another antenna structure 100 are disposed at each side of the body 11, and to prevent the first antenna 110, the second antenna 120, and the third antenna 130 located at the same side of the body 11 from interfering with each other, the first antenna 110 and the second antenna 120 disposed side by side are orthogonally polarized. The shortest distance G3 between the first antenna 110 and the third antenna 130 is greater than or equal to 38 mm to improve isolation. The shortest distance between the second antenna 120 and the third antenna 130 is greater than the shortest distance G3.

Based on the above, the antenna structure of the present disclosure integrates a plurality of antennas, and the antennas operate at two or more different frequencies. In addition, polarization directions of antennas with the same frequency are orthogonal to each other, so that the isolation between the antennas can be increased. Therefore, the antenna structure and the electronic device using the antenna structure of the present disclosure not only can operate at multiple frequencies, but also have good wireless transmission quality. Moreover, the electronic device using the antenna structure can reduce the number of antennas required, thereby reducing the manufacturing costs and meeting the design requirements of product miniaturization.

Although the present disclosure has been described with reference to the above embodiments, the embodiments are not intended to limit the present disclosure. Any person of ordinary skill in the art may make variations and improvements without departing from the spirit and scope of the present disclosure. Therefore, the protection scope of the present disclosure should be subject to the appended claims.

What is claimed is:

1. An antenna structure, comprising:

a first antenna, operating at a first frequency;

a second antenna, operating at the first frequency, wherein the first antenna is disposed side by side with the second antenna and the first antenna and the second antenna are orthogonally polarized;

a third antenna, operating at a second frequency, wherein the second frequency is lower than the first frequency; and a first grounding portion, comprising a first side edge and a second side edge opposite to each other, wherein the first antenna and the second antenna are connected to the first side edge and the third antenna is connected to the second side edge, wherein the first antenna and the second antenna are disposed on a first plane, the third antenna is disposed on a second plane, and an angle is formed between the first plane and the second plane.

2. The antenna structure according to claim 1, wherein the angle between the first plane and the second plane ranges from 75 degrees to 90 degrees.

3. The antenna structure according to claim 2, wherein the first grounding portion is disposed on a third plane, an angle between the first plane and the third plane is an obtuse angle, and an angle between the second plane and the third plane is an obtuse angle.

4. The antenna structure according to claim 1, wherein a shortest distance between the second antenna and the third antenna ranges from 30 mm to 35 mm.

5. The antenna structure according to claim 1, wherein the first antenna comprises a first slot dividing the first antenna into two first branches, and the second antenna comprises a second slot dividing the second antenna into two second branches, wherein the first slot comprises a first segment extending along a first direction and a second segment extending along a second direction, the first direction and the second direction are perpendicular to each other, the second segment extends toward the first side edge of the first grounding portion, an end of the second segment does not reach the first side edge of the first grounding portion, and the second slot extends toward the first side edge of the first grounding portion along the second direction, and an end of the second slot does not reach the first side edge of the first grounding portion.

6. The antenna structure according to claim 5, wherein a first distance between the end of the second segment of the first slot and the first side edge of the first grounding portion is less than a second distance between the end of the second slot and the first side edge of the first grounding portion.

7. The antenna structure according to claim 1, wherein the third antenna comprises a slot dividing the third antenna into two branches, the slot comprises a first segment and a second segment, the first segment and the second segment are perpendicular to each other, and the first segment is located between the second segment and the second side edge of the first grounding portion.

8. The antenna structure according to claim 7, wherein each of the branches of the third antenna comprises a connection portion, a radiation portion, and a bending portion connecting the connection portion and the radiation portion, the two connection portions are connected to the second side edge of the first grounding portion, the two connection portions are separated by the first segment, the two bending portions are separated by the second segment, and the two radiation portions are located at two opposite sides of the two bending portions.

9. The antenna structure according to claim 1, further comprising a second grounding portion, wherein the first antenna and the second antenna are connected to the first side edge of the first grounding portion through the second grounding portion, and the first antenna, the second antenna, and the second grounding portion are disposed on the same plane.

10. The antenna structure according to claim 1, wherein the first antenna, the second antenna, the first grounding portion, and the third antenna are an integrally formed metal sheet structure.

11. An electronic device, comprising:

a body, and at least one antenna structure disposed around the body and electrically connected to the body, each of the at least one antenna structure comprising:

a first antenna, operating at a first frequency;

a second antenna, operating at the first frequency, wherein the first antenna is disposed side by side with the second antenna and the first antenna and the second antenna are orthogonally polarized;

a third antenna, operating at a second frequency, wherein the second frequency is lower than the first frequency; and a first grounding portion, comprising a first side edge and a second side edge opposite to each other, wherein the first antenna and the second antenna are connected to the first side edge and the third antenna is connected to the second side edge, wherein the first antenna and the second antenna are disposed on a first plane, the third antenna is disposed on a second plane, and an angle is formed between the first plane and the second plane.

12. The electronic device according to claim 11, wherein the number of the antenna structures is at least two, and the first antenna of one of the two antenna structures and the third antenna of another one of the two antenna structures are disposed on the same side of the body.

13. The electronic device according to claim 12, wherein a shortest distance between the first antenna of one of the two antenna structures and the third antenna of the another one of the two antenna structures is greater than or equal to 38 mm.

* * * * *